United States Patent [19]

Seiki et al.

[11] 4,291,438

[45] Sep. 29, 1981

[54] FIBER FEEDING ROLLER OF OPEN-END SPINNING APPARATUS

[75] Inventors: Kazuo Seiki; Noriaki Miyamoto, both of Kariya, Japan

[73] Assignee: Kabushiki Kaisha Toyoda Jidoshokki Seisakusho, Kariya, Japan

[21] Appl. No.: 119,593

[22] Filed: Feb. 7, 1980

[30] Foreign Application Priority Data

Feb. 17, 1979 [JP] Japan ..... 54-19617

[51] Int. Cl.[3] ..... D01G 19/10

[52] U.S. Cl. ..... 19/112; 19/97; 29/121.1; 29/121.5; 57/58.91

[58] Field of Search ..... 19/97, 105, 112; 29/121.1, 121.4, 121.5; 57/58.91

[56] References Cited

U.S. PATENT DOCUMENTS

| | | | |
|---|---|---|---|
| 2,442,333 | 6/1948 | Bacon | 19/105 |
| 3,115,683 | 12/1963 | Reiterer | 19/105 |
| 3,762,144 | 10/1973 | Didék | 57/58.91 |
| 4,135,355 | 6/1979 | Stewart | 19/112 X |

FOREIGN PATENT DOCUMENTS

| | | | |
|---|---|---|---|
| 900071 | 12/1953 | Fed. Rep. of Germany | 19/105 |
| 1036725 | 8/1958 | Fed. Rep. of Germany | 19/97 |
| 2805718 | 8/1979 | Fed. Rep. of Germany | 57/58.91 |
| 1551236 | 12/1968 | France | 19/97 |

*Primary Examiner*—Louis Rimrodt

*Attorney, Agent, or Firm*—Sughrue, Mion, Zinn, Macpeak and Seas

[57] ABSTRACT

Disclosed herein is a fiber feeding roller for an open-end spinning apparatus, wherein a plurality of projections with flat surface are formed in rows extending in axial direction of the body of said fiber feeding roller on the outer circumferential surface thereof and, simultaneously, a plurality of projections with knurled surface are arranged between the aforesaid projections with flat surface, whereby preventing harmful sliver slippage on said feeding roller and also providing a uniform nip for the sliver irrespective of the size thereof so that said fiber feeding roller may be applicable to a wider range of count numbers of spinning yarns and the quality of such spinned yarns may be improved as well.

5 Claims, 6 Drawing Figures

FIBER FEEDING ROLLER OF OPEN-END SPINNING APPARATUS

BACKGROUND OF THE INVENTION

The present invention relates to improved configuration of fiber feeding roller of a conventional open-end spinning apparatus.

In the conventional open-end spinning apparatus, the feeding roller disposed at the inlet for fibers in the spinning body is adapted to operate in conjunction with a pressing member as a mechanism for supplying a bundle of fibers to the combing section from which such fibers are fed further to the stripping or doffing section while being moved through the fiber carrying passage formed by and between the spinning body and the combing roller disposed therein and, simultaneously, being separated into individual fibers under the influence of combing action of said combing roller. The fibers thus separated are entrained by air stream discharged from the air outlet and then introduced into the spinning rotor, whereby said open-end fibers are spinned and twisted into a continuous length of yarn.

For supplying a bundle of fibers to the combing roller, there have been heretofore mainly two types in configuration of fiber feeding rollers both of which are so arranged as to coact with a presser for said fiber feeding purpose: One configuration of feeding roller, probably named as the grooved type, has had a number of grooves formed on the outer circumferential surface of the feeding roller body and extending either in direction straight with and parallel to the axis of said feeding roller body or in any oblique or spiral direction on said circumferential surface, the projections formed thereby between such grooves on said circumferential surface being capable of serving in conjunction with the presser to provide nip for the bundle of fibers to be supplied to the combing roller; while the other configuration of fiber feeding roller, may be referred to as the knurled type, is provided on its entire outer circumferential surface thereof with a number of knurls, e.g. in the form of pyramidal knurled projections, which act in association with the presser to nip the fibers by impaling action of those knurls for the purpose of feeding fibers to the combing roller.

However, the former grooved type fiber feeding roller, which has no knurled surface similar to that formed on the latter type, can nip the fibers more uniformly but will allow higher rate of slippage of fibers on feeding roller than the knurled type fiber feeding roller, and the difference in the rate of slippage of fibers between these two types will become more remarkable with an increase of weight of the sliver per unit length to be supplied, or with a decrease of count number of the yarn to be spinned.

On the other hand, the knurled type fiber feeding roller having no straight or spiral projections similar to those on the former grooved type can prevent fibers from slipping on feeding roller, but its knurled surface will pose a problem of irregular nipping of fibers due to their impaling action, thus becoming inferior to the grooved type in terms of U% (or variation of yarn in spinned thickness) and IPI value (or variation in yarn thickness with reference to a standard thickness) of the spinned yarn, i.e. it becoming more difficult to spin yarn successfully with a decrease of the sliver weight per unit length to be supplied, or with an increase of count number of the yarn to be spinned. In this way, these two forms of fiber feeding rollers have had complementary advantages, but also disadvantages in the same way.

Therefore, the grooved type fiber feeding roller have been used mainly for spinning fibers into a thinner yarn with relatively small weight per unit length, while the other knurled type utilized for spinning a thicker yarn having relatively large weight per unit length, thus their practical applications being limited to a narrow range of count numbers of yarn and a single feeding roller being unable to cover or handle a wide range of count numbers of yarn such as from $N_e$ 3 to $N_e$ 45.

SUMMARY OF THE INVENTION

The object of the present invention is, therefore, to eliminate the aforementioned disadvantages by providing the open-end spinning apparatus with improved fiber feeding rollers by use of which the rate of slippage of fibers on feeding roller can be much reduced and uniformity in fiber nipping may be increased, thereby said fiber feeding rollers being applicable to a wider range of count numbers of spinning yarns and thus improving the quality of such yarns.

DETAILED DESCRIPTION OF THE PREFERRED EMBODIMENT

Figure 1:
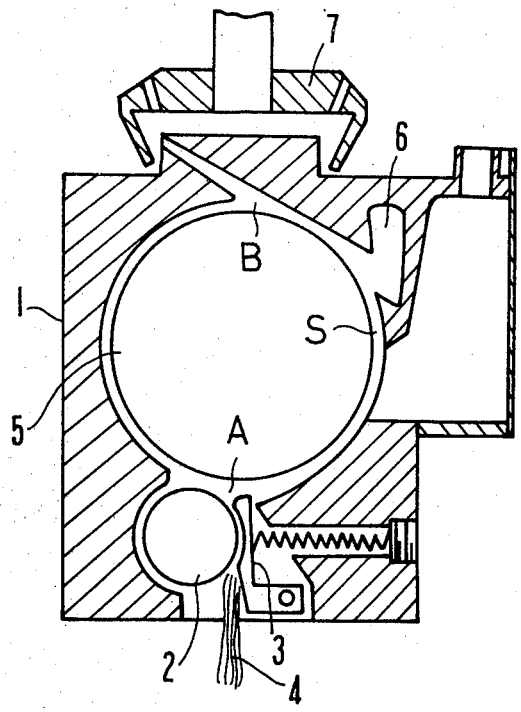
FIG. 1 PRIOR ART
FIG. 1 is a schematic side sectional view of a conventional open-end spinning apparatus.

Referring to FIG. 1 showing a conventional form of open-end spinning apparatus in section, the fiber feeding roller 2 provided at the inlet for the sliver 4 formed in the spinning body 1 and connecting to the combing section A of the fiber carrying passage S formed by and between said spinning body 1 and the combing roller 5 provided therein is adapted to operate in coaction with the presser 3 to supply the sliver 4 or a bundle of fibers to said combing section A, from which such fibers are delivered to the stripping or doffing section B through said fiber carrying passage S while being separated into individual fibers by combing action of said combing roller 5. Thereafter, the fibers thus separated from the sliver 4 are entrained by air stream discharged from the air outlet 6 and then introduced into the spinning rotor 7, wherein said open-end fibers are spinned and twisted into a continuous length of yarn.

Figure 2:
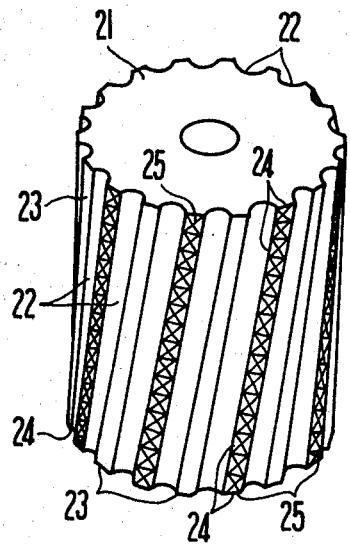
FIG. 2 is an overall perspective view of the fiber feeding roller embodied from the present invention.

Referring to FIG. 2, it shows a novel configuration of fiber feeding roller embodied according to the present invention and usable in the above open-end spinning apparatus. The fiber feeding roller comprises a usual cylindrical shaped body 21 the outer circumferential surface of which is formed with a series of grooves 22 extending in rows obliquely or spirally all the way from the top to bottom edges thereof and being spaced equidistantly from each other to provide a series of equally spaced and alternating projections 23 and 25 each disposed between said grooves 22 on the feeding roller body 21 surface, said alternating projections 23 each having a flat surface and the other alternating projections 25 each having a number of pyramidal knurls 24 formed thereon, as shown in FIG. 2.

To describe more in detail for your reference, the projections 23 with flat surface and the projections 25 with knurled surface shown in FIG. 2 which merely illustrates the embodiment of the invention schematically, the surfaces of the former projections 23 and the tips of knurls 24 of the latter projections 25 are formed preferrably in such a manner that all such surfaces and tips are located on the same phantom circumference concentric with the feeding roller body 21, namely in such a way that their distances from the axis of said feeding roller body 21 are all equal. Such dimensional feature is applicable also to other embodiments presented by FIGS. 3 to 6.

By arranging thus alternately on the outer circumferential surface of fiber feeding roller body 21 such two different kinds of projections 23 and 25, harmful slippage of supply sliver 4 on feeding roller may be prevented effectively by the latter rows of projections 25 having pyramidal knurls 24 formed thereon, while the former rows of projections 23 with flat surface can serve to provide a uniform nip for the supply sliver 4.

It will be evident, therefore, that in spinning thicker yarns with smaller count numbers the sliver 4 which is relatively heavy per unit length can be fed smoothly by the projections 25 with knurled surface without any slippage, and in spinning thinner yarns with larger count numbers the projections 23 with flat surface can help nip uniformly the supply sliver which is relatively light per unit length, whereby the fiber feeding roller configuration disclosed in FIG. 2 will be superior to the aforesaid grooved type feeding roller in reduction of sliver slippage on feeding roller and also to the aforementioned knurled type in terms of U% and IPI value, thus permitting application thereof to a much wider range of thickness of yarns to be spinned, as well as helping to improve the yarn quality.

Figure 3:
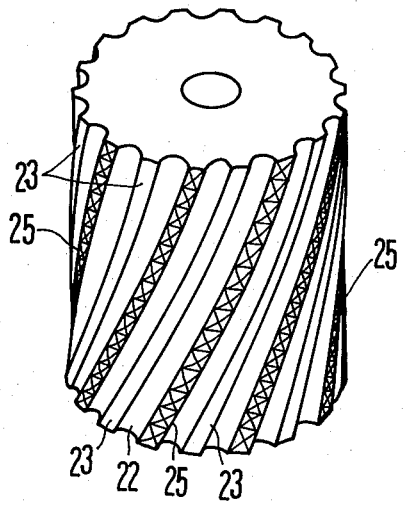
FIGS. 3 to 6 are similar perspective views showing modified forms of feeding rollers of the invention.

Referring to FIGS. 3 to 6, they show modified versions of fiber feeding roller according to the present invention:

FIG. 3 illustrates a modified form of feeding roller, wherein on the outer circumferential surface of its body 21 there formed rows of grooves 22 each interposed in a similar manner between a projection 23 with flat surface and a projection 25 with a plurality of knurls 24 but formed with more degree of obliqueness or spiral. By so arranging the grooves 22, the projections 23 and 25 can alternate not only in circumferential direction of the feeding roller body 21, but also in axial direction thereof to contribute to still more uniform action of the feeding roller in sliver nipping.

Figure 4:
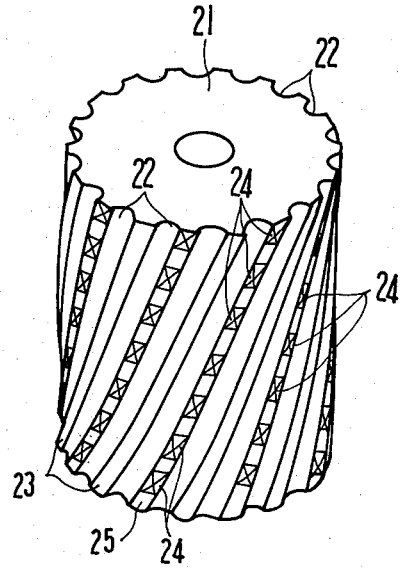
Figure 5:
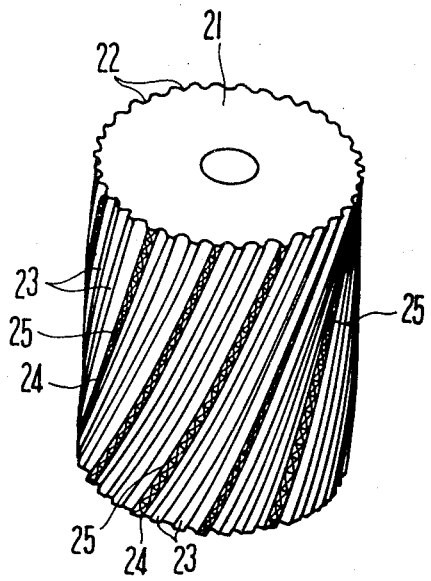
Figure 6:
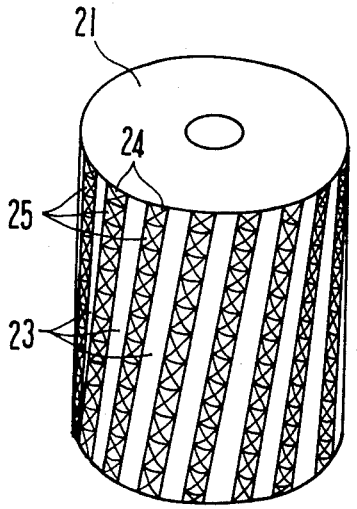

FIG. 4 represents another modified embodiment of feeding roller of the invention which is similar to the above modification but differs in that the knurls 24 on each row of the projections 25 are formed with flat surfaces interposed therebetween in equally spaced relation. FIG. 5 shows still another configuration of feeding roller of the invention, wherein the ratio in number of the projections 23 with flat surface to the projections 25 having knurled surface is different; in the embodiment shown in FIG. 5, one projection 25 with knurls 24 is arranged next to each two rows of projections 23 with flat surface, thus the number of the latter projections 23 being increased. In such an embodiment, the former projections 25 may be increased instead.

In the last example of modifications in which no groove is provided, the projections 23 with flat surface and projections 25 with knurled surface alternate continuously with no groove, such as those grooves 22, interposed therebetween on the circumferential surface of the fiber feeding roller body 21.

In addition to the above-explained forms of embodiment of the invention, the following further modified configurations of feeding roller are possible:

(A) A fiber feeding roller wherein the alternating projection 23 with flat surface and projections 25 with knurls 24 are formed straight with and parallel to the axis of feeding roller body 21 on the outer circumferential surface thereof;

(B) A fiber feeding roller wherein a projection having both knurled and flat surfaces on the upper and lower halves, respectively, of said projection and a projection of inverted form, or having both flat and knurled surfaces on its upper and lower halves, respectively, are arranged in an alternating and repeated pattern all around the outer circumferential surface of feeding roller body 21;

(C) A fiber feeding roller with different depth and width of the grooves 22 disposed between the projections 23 with flat surface and the projections 25 with knurls 24; and (D) A fiber feeding roller wherein the knurls 24 on the projections 25 are formed in the shape of cone, trigonal pyramid, or other shapes.

As is now evident from the above description to those skilled in the art, the present invention discloses novel and improved forms of fiber feeding roller for an open-end spinning apparatus, according to which a plurality of projections with flat surface are formed in rows extending in axial direction of said fiber feeding roller body on the outer circumferential surface thereof and, simultaneously, projections with knurled surface are arranged between neighboring rows of said projections with flat surface, said fiber feeding roller thus serving the purpose of smooth feeding of sliver to the combing section in said open-end spinning apparatus irrespective of its varying size by preventing harmful slippage of said sliver on feeding roller and also providing uniform nipping for the sliver to be supplied, so that the fiber feeding roller of the present invention may be applicable to a wider range of count numbers of spinning yarns, as well as to contribute to improvement of such spinned yarns.

What is claimed is:

1. A fiber feeding roller in a fiber-bundle supply mechanism in which said feeding roller is so adapted as to coact with a pressing member to supply a bundle of fibers to fiber separating mechanism in an open-end spinning apparatus, the outer circumferential surface of body of said feeding roller being formed with a plurality of rows of projections having flat surface thereon and extending in axial direction of said feeding roller body and a plurality of rows of projections having knurled surface formed thereon are arranged between said projections with flat surface.

2. A fiber feeding roller according to claim 1, wherein said plurality of projections with flat surface are formed obliquely or spirally and in equally spaced relation and said plurality of projections with knurled surface are disposed therebetween.

3. A fiber feeding roller according to claim 1, wherein said projections with flat surface and said projections with knurled surface are arranged in alternating and repeated manner on the outer circumferential surface of said feeding roller body.

4. A fiber feeding roller according to claim 1, wherein the ratio in number between said projection with flat surface and said projection with knurled surface is two (2) or more.

5. A fiber feeding roller according to claim 1, wherein said plurality of projections with flat surface and said plurality of projections with knurled surface are formed with no space interposed therebetween.

* * * * *